United States Patent [19]

Latham

[11] 4,024,999

[45] May 24, 1977

[54] ANKLET TACK BELT

[75] Inventor: Otis D. Latham, Pueblo, Colo.

[73] Assignee: The Raymond Lee Organization, Inc., New York, N.Y. ; a part interest

[22] Filed: Nov. 3, 1975

[21] Appl. No.: 628,041

[52] U.S. Cl. ..... 224/5 R; 206/347; 224/5 C; 224/22

[51] Int. Cl.[2] ..... A45C 11/00

[58] Field of Search ..... 224/5 R, 5 A, 5 B, 5 C, 224/13, 21, 22, 26 B, 26 F, 26 R, 28 R, 28 P, 28 B, 23; 206/338, 347, 234, 381, 382; 2/22, 94, 239; 223/109 R

[56] References Cited

UNITED STATES PATENTS

| | | | |
|---|---|---|---|
| 635,145 | 10/1899 | Orndorff | 224/28 R |
| 793,726 | 4/1905 | Kerney | 224/5 C |
| 1,703,138 | 2/1929 | Falcone et al. | 224/5 C |
| 1,955,650 | 4/1934 | Obarski | 224/5 C |
| 2,007,696 | 7/1935 | Siebert | 224/5 C |
| 2,186,191 | 1/1940 | Beckwith | 224/28 R X |
| 2,306,365 | 12/1942 | Stair | 224/22 |
| 2,691,779 | 10/1954 | Bell | 224/5 C X |
| 3,322,311 | 5/1967 | Homer | 224/5 R |
| 3,933,286 | 1/1976 | Karkas | 224/28 P |

*Primary Examiner*—Robert J. Spar
*Assistant Examiner*—Winston H. Douglas
*Attorney, Agent, or Firm*—Howard I. Podell

[57] ABSTRACT

A belt for holding of surveyors' tacks which may be worn about the ankle of the user. The belt is fitted at each end with snap fasteners, with a mid-section shaped as a cylinder and fitted with vertical holes through the top of the mid-section, in the worn position of the belt. Surveyors' tacks are individually located in each hole with the tack points protected inside the belt. The anklet belt enables a surveyor to readily grasp a tack from the belt, when kneeling, and fasten the tack at a surveyed point.

2 Claims, 6 Drawing Figures

ANKLET TACK BELT

SUMMARY OF THE INVENTION:

My invention is a belt for holding of surveyors' tacks which may be worn about the ankle of the user. The belt is fitted at each end with snap fasteners, with a mid-section shaped as a cylinder and fitted with vertical holes through the top of the mid-section, in the worn position of the belt. Surveyors' tacks are individually located in each hole with the tack points protected inside the belt. The anklet belt enables a surveyor to readily grasp a tack from the belt, when kneeling, and fasten the tack at a surveyed point.

BRIEF DESCRIPTION OF THE DRAWINGS:

The objects and features of the invention may be understood with reference to the following detailed description of an illustrative embodiment of the invention, taken together with the accompanying drawings in which.

Figures 1, 2, 3, 4, 5, 6:
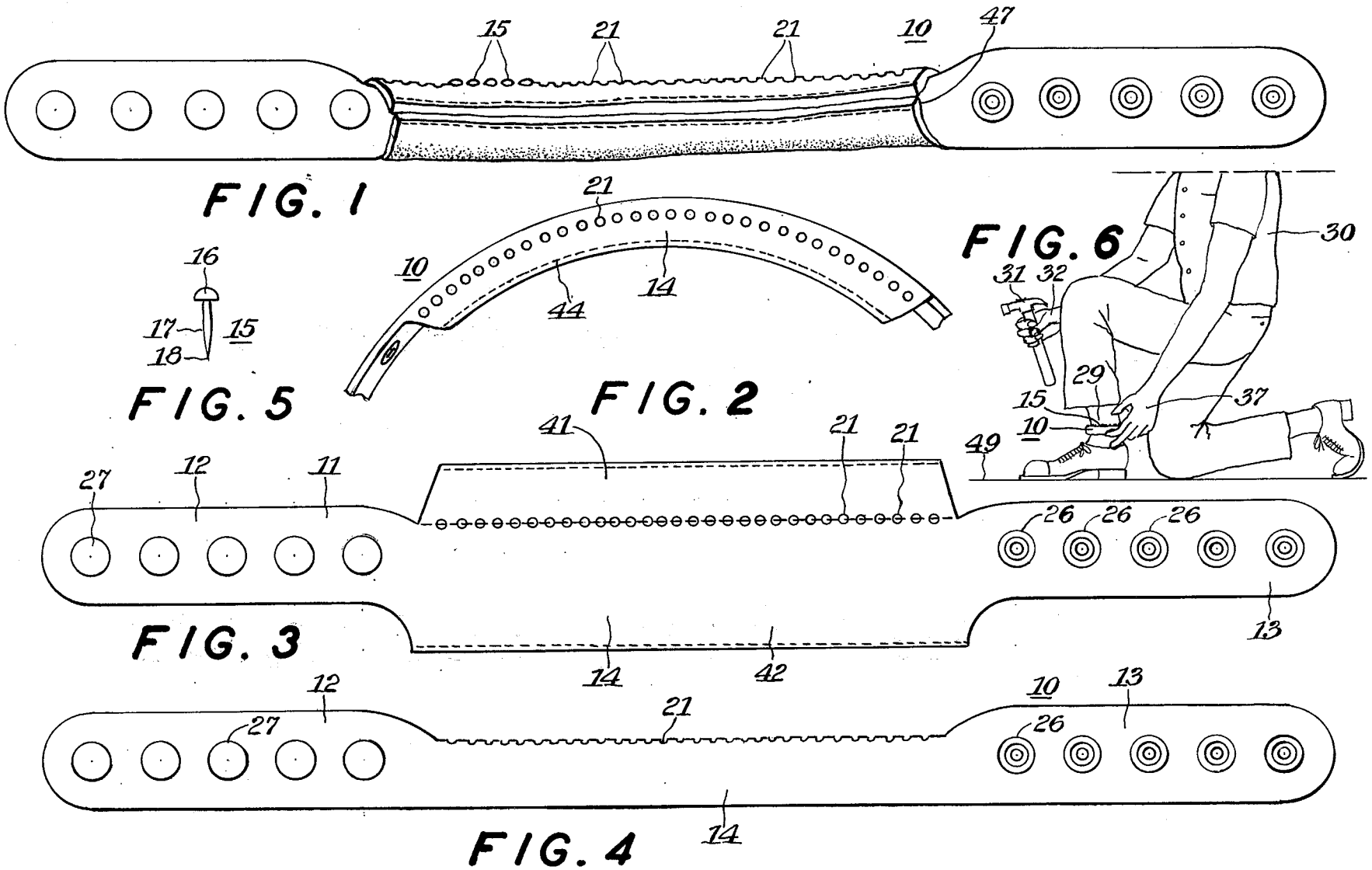
FIG. 1 is an inside elevation view of the invention.
FIG. 2 is a fragmentary play view of the invention.
FIG. 3 is a side view of the belt, prior to folding.
FIG. 4 is an outside elevation view of the invention.
FIG. 5 is an elevation view of a surveyors' tack employed with the belt.
FIG. 6 is a perspective view of the invention in use.

DESCRIPTION OF THE PREFERRED EMBODIMENT:

Turning now descriptively to the drawings, in which similar reference characters denote similar elements throughout the several views, FIGS. 1–4 illustrate the anklet belt 10 which is formed of a shaped sheet 11 of material with two narrow end flaps 12 and 13 and a wide intermediate section 14.

A plurality of spaced female snap fasteners 26 are fastened to end flap 13 with an equal number of mating male snap fasteners 27 mounted in end flap 12 located so as to fasten to the female fasteners 26 when the belt 10 is fitted about the ankle 29 of a surveyor 30.

Intermediate section 14 is formed as a cylindrical shape with the projecting flaps 41 and 42 rolled about the body of the belt and held in place by stitches 44.

A series of through holes 21 are formed in the top flap 41 of the intermediate section along the length of the intermediate section 14 with the holes 21 lying along the top plane of the belt 10 in the fastened mode as shown in FIG. 6. Holes 21 each hold a surveyor's tack 15, shown in FIGS. 5–6, with the point 18 and shank 17 of tack 15 protected in the recess 47 in the interior of belt 10 about which tabs 41 and 42 are rolled, and with the head 16 of tack 15 resting on the exterior of the belt 10.

The belt 10 is readily fastened about the ankle 29 of a surveyor 30 so that the surveyor may kneel and readily grasp a tack 15 from belt 10 with one hand 37 while holding a hammer 31 with the other hand 32 with which to drive the tack 15 through a surveyed point near the ground level 49.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A belt adaptable for fastening about an ankle of a wearer, said belt is formed of an individual section of flat material comprising an intermediate section joined at each end by a relatively narrower end section, said immediate section rolled to form a cylindrical wall bounding an interior recess, each said flat end section fitted with detachable fastener means for joining both end sections together, said intermediate section formed with a plurality of holes that extend through the wall of the intermediate section into the interior recess bounded by the intermediate section, said holes located so as to lie along the top plane of the belt, when the flat end sections are fastened about an ankle, with each said hole of a size to fit about a surveyor's tack mounted through said hole, the shank and point of which said tack being enclosed in the interior of said intermediate section, when so mounted.

2. The combination as recited in claim 1 in which an end section is fitted with a plurality of detachable fastener means for purposes of adjustment.

* * * * *